US005791906A

United States Patent [19]

Robinson, Jr.

[11] Patent Number: 5,791,906

[45] Date of Patent: Aug. 11, 1998

[54] SKATERS' BELT ASSEMBLY

[76] Inventor: William A. Robinson, Jr., 17085 Rancho, Encino, Calif. 91316

[21] Appl. No.: 726,062

[22] Filed: Oct. 3, 1996

[51] Int. Cl.[6] ..... G09B 19/00

[52] U.S. Cl. ..... 434/255

[58] Field of Search ..... 434/253, 255, 434/258, 247, 250

[56] References Cited

U.S. PATENT DOCUMENTS

| | | | |
|---|---|---|---|
| 2,737,154 | 3/1956 | Michonski . | |
| 3,458,188 | 7/1969 | Infante . | |
| 4,214,382 | 7/1980 | Matsutani | 434/247 |
| 4,445,866 | 5/1984 | Cillieres | 434/253 |
| 4,667,624 | 5/1987 | Smith . | |
| 4,788,941 | 12/1988 | Villeneuve . | |
| 4,993,366 | 2/1991 | Sager . | |
| 5,002,273 | 3/1991 | Sela | 434/255 X |
| 5,324,220 | 6/1994 | Stewart . | |
| 5,370,286 | 12/1994 | Newman . | |

*Primary Examiner*—Jeffrey A. Smith
*Attorney, Agent, or Firm*—Patrick F. Bright

[57] ABSTRACT

An extendible, retractable, dual belt assembly for linking two skaters to one another and for use by such skaters simultaneously includes, at each end, a belt assembly for attachment around the waist or mid-section of a skater with the belts joined to one another by expandable/contractible sections and by relatively inextendible tubular sections.

3 Claims, 3 Drawing Sheets

SKATERS' BELT ASSEMBLY

This invention relates to an extensible, retractable dual belt assembly for linking two skaters to one another, and for use by such skaters simultaneously. Advantageously, this assembly permits each of the two skaters to skate freely and with minimal interference from the other skater. Among the preferred uses are roller skating, roller blading and ice skating.

In preferred embodiments, this dual belt assembly includes, at one end, an adjustable belt to be worn around the waist or mid-section of one skater, and, at the other end, a similar belt to be worn around the waist or mid-section of another skater. Connected to each of the belts is an accordion-like, expandable/contractible section, preferably measuring about 10 inches to about 15 inches in length, and about 3 inches to about 4 inches in diameter. Connected between these expandable/contractible sections are sections of semi-rigid tubing totaling up to about 12 feet in length, preferably made-of a plastic such as acrylic, and preferably measuring from about 2 inches to about 2.5 inches across its outer diameter, from about 1.75 inches to about 2.25 inches across its outer diameter, and about 38 inches to about 42 inches in length. Alternatively, this tubing can be a single unit having a length of about 4 feet to about 12 feet.

In preferred embodiments, the tubing is formed in connectible sections to form a linkage of any desired length between the two skaters. Suitable fasteners such as bolts and nuts, connects sections of the tubing to one another. Alternatively, the sections may be joined by heat and pressure fusion

BRIEF DESCRIPTION OF THE DRAWINGS

This invention can better be understood by reference to the drawings, in which.

DESCRIPTION OF THE PREFERRED EMBODIMENTS

Figure 1:
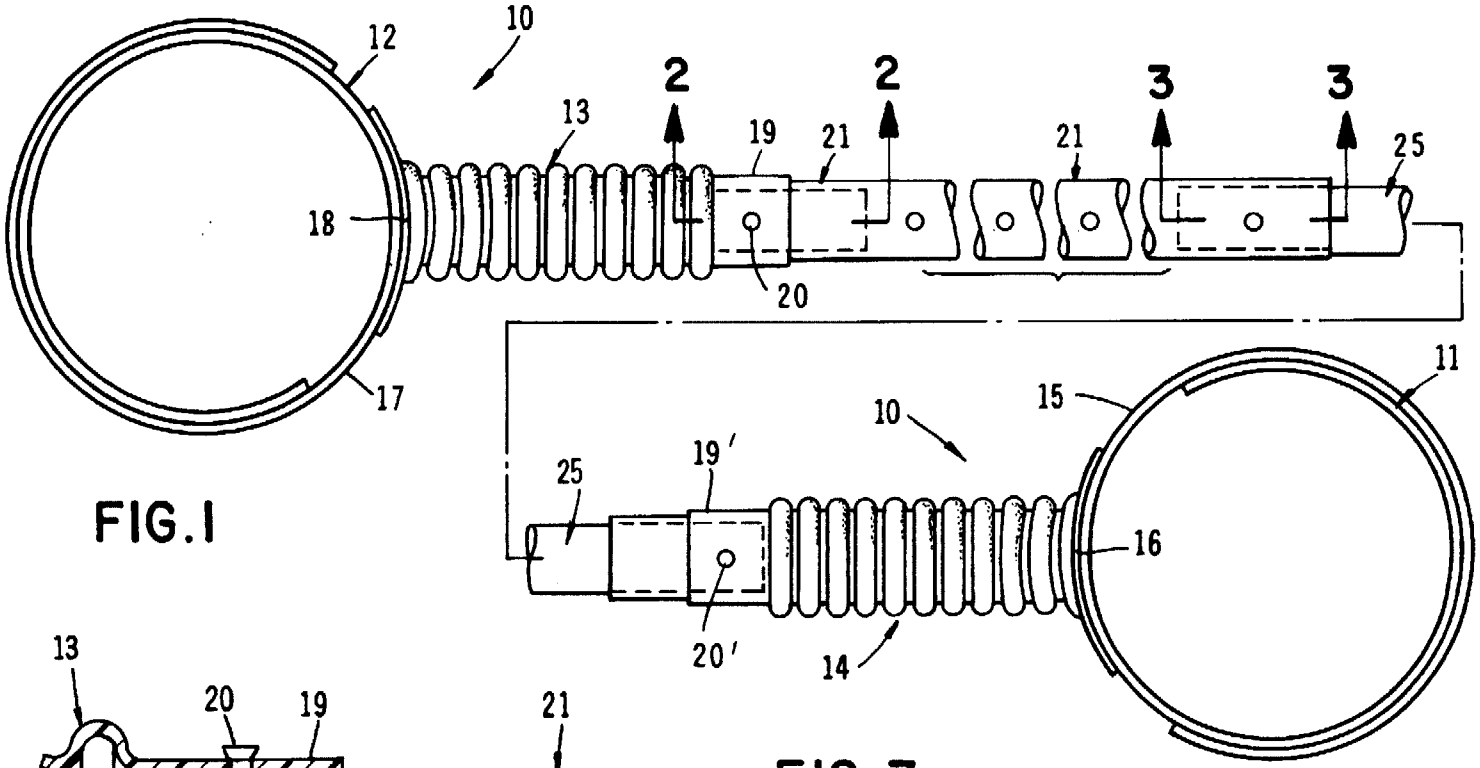
FIG. 1 shows, in side elevation view, a first embodiment of the dual belt assembly of this invention.

FIG. 1 shows a first embodiment 10 of the dual belt assembly of this invention. At one end of assembly 10 is adjustable belt 11 having a size and shape suitable to fit around the waist or mid-section of a skater. Belt 12 is similar to belt 11, and is for attachment around the waist or mid-section of a second skater. Connected to belt 11 is expandable/contractible section 14 secured to outer surface 15 of belt 11 by neoprene adhesive layer 16. Similarly, expandable/contractible section 13 is connected to outer surface 17 of belt 12 by neoprene adhesive along junction 18 between expandable/contractible section 13 and belt 12.

Figure 2:
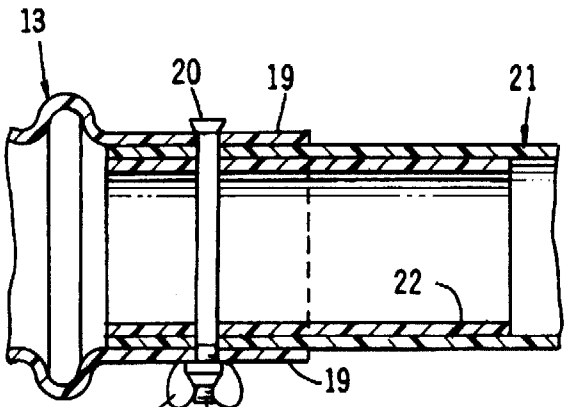
FIG. 2 shows a cross-sectional view taken on lines 2—2 of FIG. 1, of the connection between the expandable/contractible sections of the dual belt assembly, and of the tubing connecting these sections to one another.

FIG. 2 shows the connection between expandable/contractible section 13 and tubing section 21. At the end of expandable/ contractible section 13 is collar element 19. Tubing section 21, as FIG. 2 shows, fits inside element 19, and is connected thereto by bolt 20. Bolt 20 passes through the outer wall of sleeve 19, through tubing section 21, and through inner reinforcing layer 22. Bolt 20 secures sleeve 19 to tubing section 21 and to reinforcing layer 22 by passing through all three of these elements. Bolt 20 is held in place by wing nut 23 which engages a threaded end portion of bolt 20 that projects below element 19, tubing section 21 and reinforcing layer 22.

Figure 3:
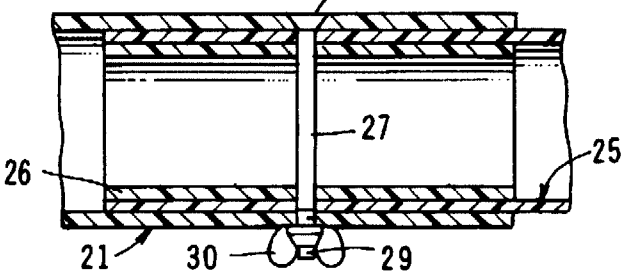
FIG. 3 shows in a cross-sectional view taken on lines 3—3 of FIG. 1, the connection between two or more sections of the tubing that forms the linkage between the expandable/contractible sections shown in FIGS. 1 and 2.
Figure 4:
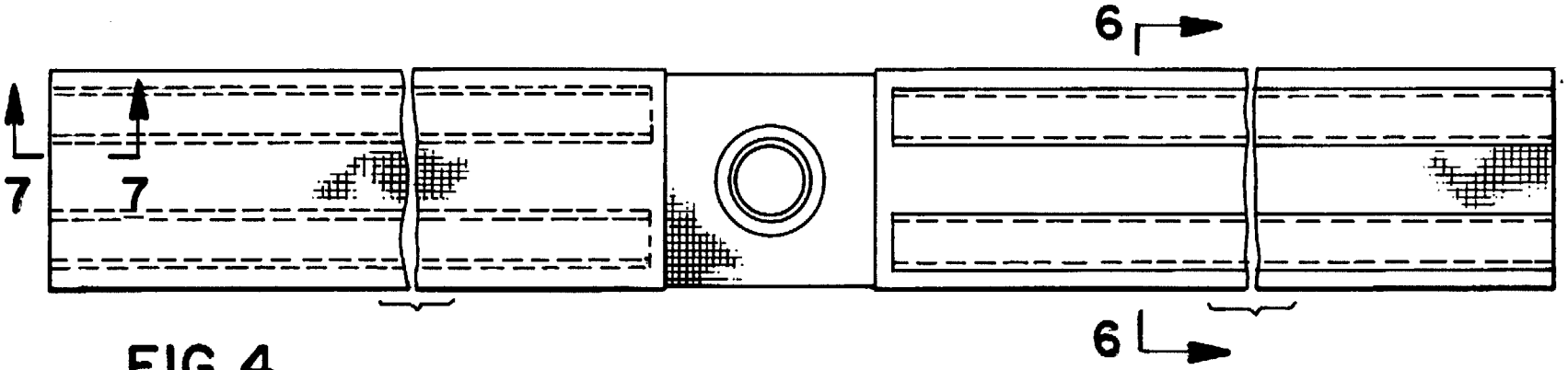
FIG. 4 shows a side elevation view of a portion of the belt in the embodiment of FIG. 1.
Figure 7:
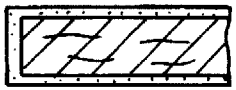
FIGS. 6 AND 7 show side and end views, respectively, of a portion of the belt assembly taken on line B—B of FIG. 4.
Figure 6:
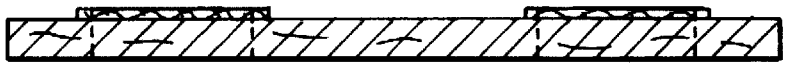
Figure 5:
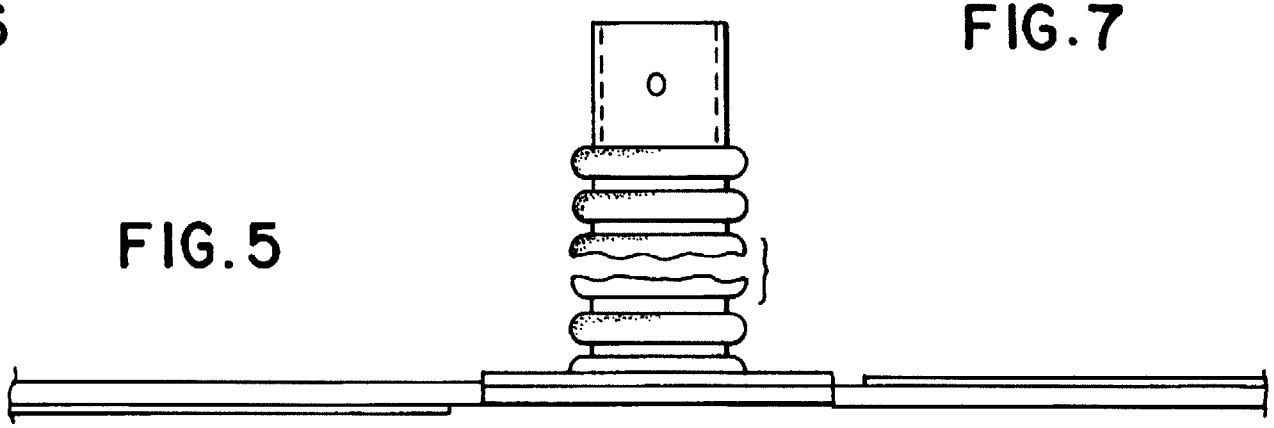
FIG. 5 shows a top plan view of the belt section shown in FIG. 4 and of the expandable/contractible section attached thereto.

FIG. 3 shows one connection between tubing sections 21 and 25. Tubing sections 21 and 25 interfit, and are reinforced with inner tubing section 26. Bolt 27 passes through openings in tube section 21, reinforcing inner tubing section 26 and tube section 25 at one end with flanged end portion 28 holding bolt 27 in place on one side of the connection. On the other side of the connection, bolt 27 terminates in threaded section 29. Wing nut 30 threads onto bolt 27 to hold bolt 27 in place. Sleeve 19'/tube section 25/wing nut 20' connect belt 11 and its expandable/contractible connector 14 to tube section 25 in the same way as sleeve 19 is joined to tube section 21 by means of bolt 20.

Figure 8:
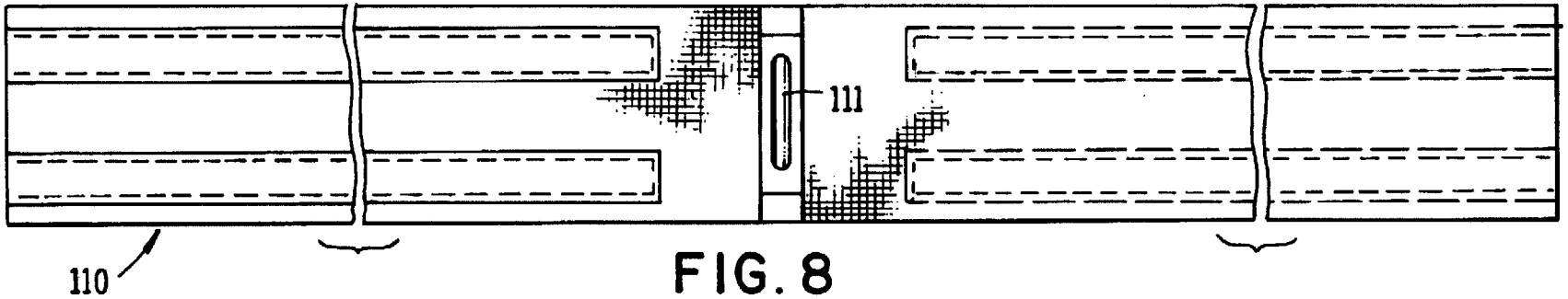
FIGS. 8 AND 9 show front elevation and side elevation views of a second embodiment of a belt for use in the dual belt assembly of this invention.
Figure 9:
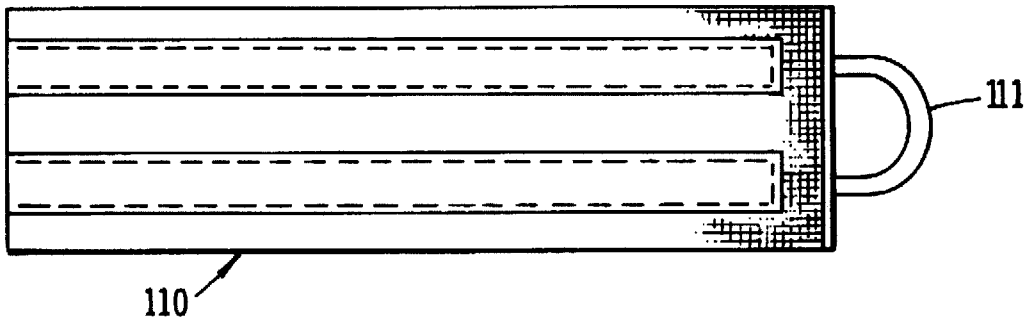
Figure 10:
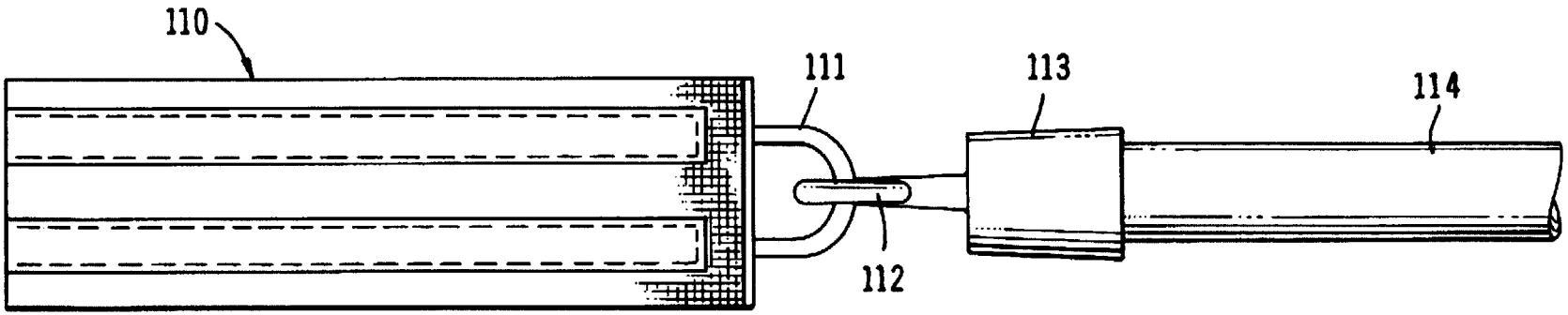
FIGS. 10 shows the elements used for connecting two belts as shown in FIGS. 8 and 9 to one another.

FIGS. 8 AND 9 show front elevation and side elevation views of a second embodiment of belt members 11, 12 in FIG. 1. Here, instead of expandable/contractible sections 13, 14, belt 110 is joined to a pole-and-sleeve connector through ring 111 attached to and projecting from the side of belt 110. Connected through ring 111 is ring 112 connected to insert one end of sleeve 113. Pole section 114 fits into and is connected to the other end of sleeve 113. At the other end of pole section 114 is another belt 110 with ring 111 connected to pole section 114 through another sleeve 113 and ring 112.

What is claimed is:

1. A belt assembly for simultaneous use by two skaters includes, at each of its two ends, a belt for attachment around the waist or mid-section of each one of said two skaters, and, connected to each of said belts, an elongated connector of sufficient length to permit said two skaters to skate side-by-side without substantial interference with one another, wherein each end of said elongated connector comprises a bendable/expandable/contractible, accordion-shaped, coil spring-free, tubular section, with each of said tubular sections being connected, at its other end, to hollow tubing of sufficient length to permit said two skaters to skate as a pair without substantial interference with one another.

2. The belt assembly of claim 1 further comprising, between each of said expandable/contractible connectors, a plurality of tube sections interfitting with one another and connected to one another by bolts passing completely through the areas where the tubular members interfit and connect with one another.

3. A belt assembly for simultaneous use by two skaters having, at each of its two ends:

a belt for attachment around the waist or mid-section for each one of said two skaters, and, connected to each of said belts, a connector ring attached to and projecting from one side of said belt; and an elongated connector connecting each of said belts side-by-side to one another, said connector including a pole having, at each end, a coil spring-free connector that includes a ring that links to the ring projecting from said belt, said elongated connector being of sufficient length and flexibility to permit said two skaters to skate side-by-side without substantial interference with one another.

* * * * *